US006652121B1

(12) United States Patent
Kneeshaw

(10) Patent No.: US 6,652,121 B1
(45) Date of Patent: Nov. 25, 2003

(54) POSITIONABLE LIGHTING SYSTEM

(76) Inventor: Paula D. Kneeshaw, 6033 Monaco St., Commerce City, CO (US) 80022

( * ) Notice: Subject to any disclaimer, the term of this patent is extended or adjusted under 35 U.S.C. 154(b) by 0 days.

(21) Appl. No.: 10/159,047

(22) Filed: May 31, 2002

(51) Int. Cl.[7] ..... F21V 21/00
(52) U.S. Cl. ..... 362/249; 362/147; 362/374
(58) Field of Search ..... 362/145, 147, 362/150, 249, 285, 240, 154, 374, 375, 404

(56) References Cited

U.S. PATENT DOCUMENTS 4,901,212 A 2/1990 Prickett
D350,612 S 9/1994 Gullblom
5,510,966 A * 4/1996 Konecny ..... 362/249
5,513,081 A 4/1996 Byers
5,707,136 A 1/1998 Byers
6,050,703 A 4/2000 Herbert
6,050,709 A 4/2000 Hastings
6,474,840 B2 * 11/2002 Padermos ..... 362/249

* cited by examiner

*Primary Examiner*—Thomas M. Sember
*Assistant Examiner*—John Anthony Ward

(57) ABSTRACT

A positionable lighting system includes a storage housing assembly that is couplable to a structure. The storage housing assembly has a bottom wall and a perimeter wall that extend upwardly from the bottom wall. The storage housing assembly has a lid portion pivotally coupled to the perimeter wall. The storage housing assembly defines an interior space. A track member is couplable to the structure. The track member has a first end adjacent to the storage housing assembly. A plurality of slideable support members is operationally couplable to the track member. Each one of the plurality of slideable support members is slideable along the track member. A plurality of lamp members is operationally couplable to the plurality of slideable support members such that the plurality of lamp members is positionable along a length of the track member. The plurality of lamp members is positionable within the storage housing assembly.

9 Claims, 2 Drawing Sheets

POSITIONABLE LIGHTING SYSTEM

BACKGROUND OF THE INVENTION

1. Field of the Invention

The present invention relates to lighting systems and more particularly pertains to a new positionable lighting system for providing a user with an improved means of decorating outdoors with lights.

2. Description of the Prior Art

The use of lighting systems is known in the prior art. More specifically, lighting systems heretofore devised and utilized are known to consist basically of familiar, expected and obvious structural configurations, not with standing the myriad of designs encompassed by the crowded prior art which have been developed for the fulfillment of countless objectives and requirements.

Known prior art includes U.S. Pat. No. 6,050,703; U.S. Pat. No. 6,050,709; U.S. Pat. No. 5,707,136; U.S. Pat. No. 4,901,212; U.S. Pat. No. 5,513,081; and U.S. Pat. No. Des. 350,612.

While these devices fulfill their respective, particular objectives and requirements, the aforementioned patents do not disclose a new positionable lighting system. The inventive device includes a storage housing assembly that is couplable to a structure. The storage housing assembly has a bottom wall and a perimeter wall that extend upwardly from the bottom wall. The storage housing assembly has a lid portion pivotally coupled to the perimeter wall the storage housing assembly for defining an interior space. A track member is couplable to the structure. The track member is elongate. The track member has a first end adjacent to the storage housing assembly. A plurality of slideable support members is operationally couplable to the track member. Each one of the plurality of slideable support members is slideable along the track member. A plurality of lamp members is operationally couplable to the plurality of slideable support members such that the plurality of lamp members is positionable along a length of the track member. The plurality of lamp members is positionable within the storage housing assembly.

In these respects, the positionable lighting system according to the present invention substantially departs from the conventional concepts and designs of the prior art, and in so doing provides an apparatus primarily developed for the purpose of providing a user with an improved means of decorating outdoors with lights.

SUMMARY OF THE INVENTION

In view of the foregoing disadvantages inherent in the known types of lighting systems now present in the prior art, the present invention provides a new positionable lighting system construction wherein the same can be utilized for providing a user with an improved means of decorating outdoors with lights.

The general purpose of the present invention, which will be described subsequently in greater detail, is to provide a new positionable lighting system apparatus and method which has many of the advantages of the lighting systems mentioned heretofore and many novel features that result in a new positionable lighting system which is not anticipated, rendered obvious, suggested, or even implied by any of the prior art lighting systems, either alone or in any combination thereof.

To attain this, the present invention generally comprises a storage housing assembly that is couplable to a structure.

The storage housing assembly has a bottom wall and a perimeter wall that extend upwardly from the bottom wall. The storage housing assembly has a lid portion pivotally coupled to the perimeter wall the storage housing assembly for defining an interior space. A track member is couplable to the structure. The track member is elongate. The track member has a first end adjacent to the storage housing assembly. A plurality of slideable support members is operationally couplable to the track member. Each one of the plurality of slideable support members is slideable along the track member. A plurality of lamp members is operationally couplable to the plurality of slideable support members such that the plurality of lamp members is positionable along a length of the track member. The plurality of lamp members is positionable within the storage housing assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new positionable lighting system apparatus and method which has many of the advantages of the lighting systems mentioned heretofore and many novel features that result in a new positionable lighting system which is not anticipated, rendered obvious, suggested, or even implied by any of the prior art lighting systems, either alone or in any combination thereof.

It is another object of the present invention to provide a new positionable lighting system which may be easily and efficiently manufactured and marketed.

It is a further object of the present invention to provide a new positionable lighting system which is of a durable and reliable construction.

An even further object of the present invention is to provide a new positionable lighting system which is susceptible of a low cost of manufacture with regard to both materials and labor, and which accordingly is then susceptible of low prices of sale to the consuming public, thereby making such positionable lighting system economically available to the buying public.

Still yet another object of the present invention is to provide a new positionable lighting system which provides in the apparatuses and methods of the prior art some of the advantages thereof, while simultaneously overcoming some of the disadvantages normally associated therewith.

Still another object of the present invention is to provide a new positionable lighting system for providing a user with an improved means of decorating outdoors with lights.

Yet another object of the present invention is to provide a new positionable lighting system which includes a storage housing assembly that is couplable to a structure. The storage housing assembly has a bottom wall and a perimeter wall that extend upwardly from the bottom wall. The storage housing assembly has a lid portion pivotally coupled to the perimeter wall. The storage housing assembly defines an interior space. A track member is couplable to the structure. The track member is elongate. The track member has a first end adjacent to the storage housing assembly. A plurality of slideable support members is operationally couplable to the track member. Each one of the plurality of slideable support members is slideable along the track member. A plurality of lamp members is operationally couplable to the plurality of slideable support members such that the plurality of lamp members is positionable along a length of the track member. The plurality of lamp members is positionable within the storage housing assembly.

Still yet another object of the present invention is to provide a new positionable lighting system that save time and energy, instead of spending time each year mounting the lights outside, this product could be stored outdoors at all times without being and eyesore.

Even still another object of the present invention is to provide a new positionable lighting system that prevent a user from having to continually climb up on a ladder to insert nails and other fasteners to secure decorative lights.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
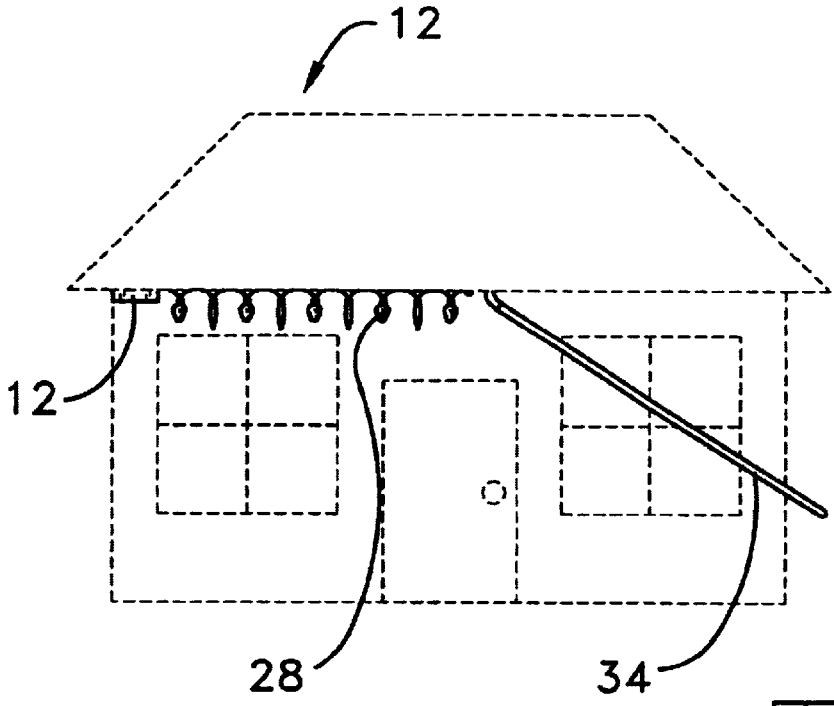
FIG. 1 is an in-use view of a new positionable lighting system according to the present invention.
Figure 3:
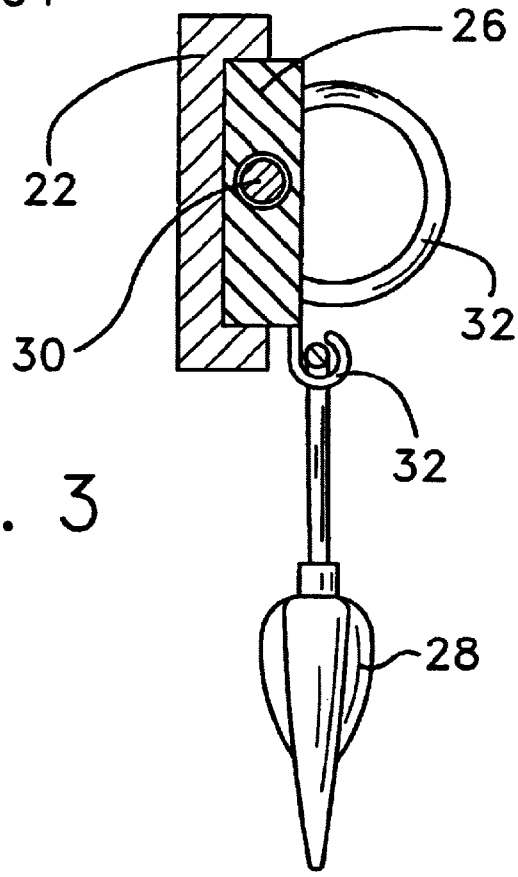
FIG. 3 is a side view of the present invention.
Figure 2:
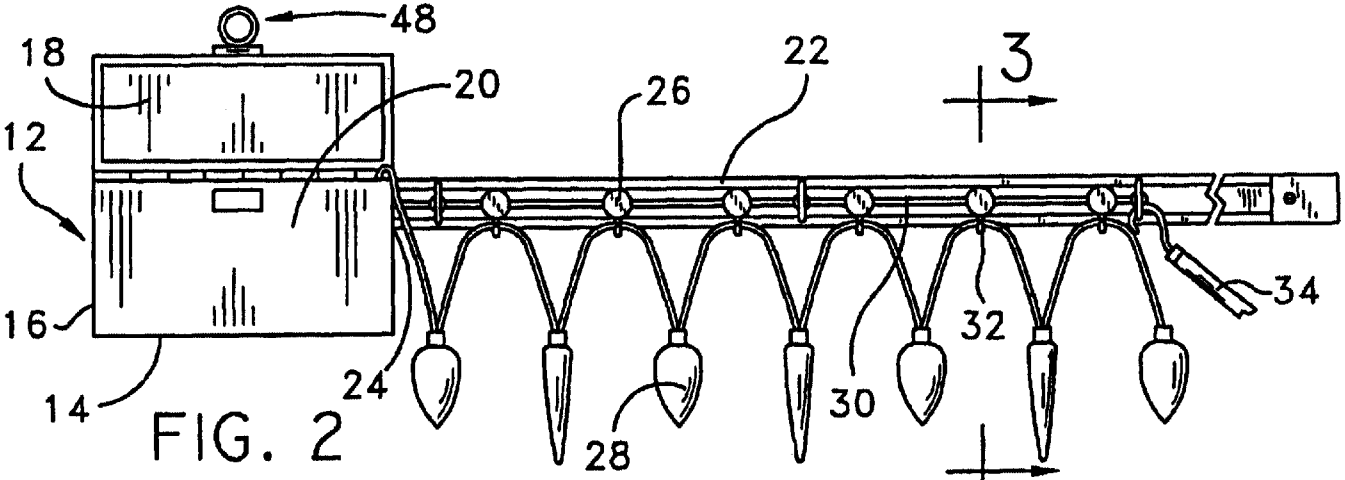
FIG. 2 is a side view of the present invention.
Figure 4:
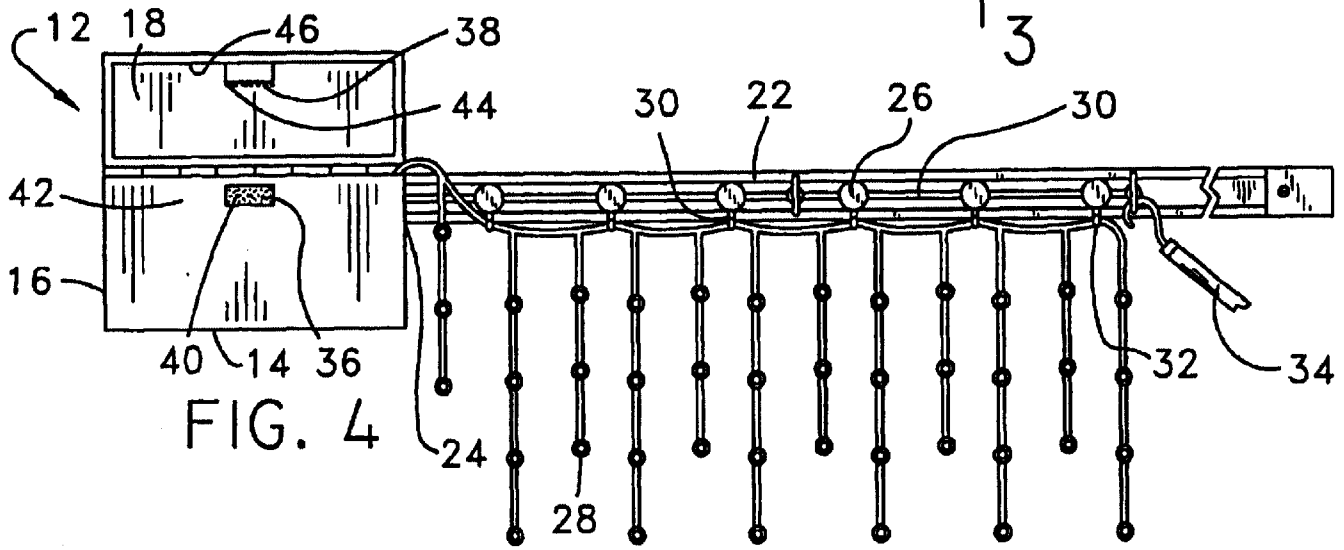
FIG. 4 is a cross-sectional view of the present invention.

With reference now to the drawings, and in particular to FIGS. 1 through 4 thereof, a new positionable lighting system embodying the principles and concepts of the present invention and generally designated by the reference numeral 10 will be described.

As best illustrated in FIGS. 1 through 4, the positionable lighting system 10 generally comprises a storage housing assembly 12 that is couplable to a structure. The storage housing assembly 12 has a bottom wall 14 and a perimeter wall 16 that extend upwardly from the bottom wall 14. The storage housing assembly 12 has a lid portion 18 pivotally coupled to the perimeter wall 16 the storage housing assembly 12 defining an interior space 20. A track member 22 is couplable to the structure. The track member 22 is elongate. The track member 22 has a first end 24 adjacent to the storage housing assembly 12. A plurality of slideable support members 26 is operationally couplable to the track member 22. Each one of the plurality of slideable support members 26 is slideable along the track member 26. A plurality of lamp members 28 is operationally couplable to the plurality of slideable support members 26 such that the plurality of lamp members 28 is positionable along a length of the track member 22. The plurality of lamp members 28 is positionable within the storage housing assembly 12.

A flexible elongate member 30 is coupled to the plurality of slideable support members 26. The flexible elongate member 30 facilitates sliding the plurality of slideable support members 26 along the track member 22 such that a lateral force applied to a first one of the plurality of slideable support members 26 is partially transferred to other slideable support members 26.

A plurality of hook members 32 is interspersed with the plurality of slideable support members 26. Each one of the plurality of hook members 32 is operationally coupled to the elongate member 30. The plurality of hook members 32 is for facilitating the plurality of slideable support members 26 along the track member 22.

A pole member 34 is for facilitating application of a lateral force along the elongate member 30 such that the plurality of slideable support members 26 are positionable along the track member 22 whereby the plurality of lamp members 28 are positionable along a length of the track member. The storage housing assembly 12 is coupled to a vertical support surface such as an external wall of a house.

The pole member 34 has a length of approximately 12 feet. The plurality of hook members 32 further includes three hook members 32. The pole member 34 is for selectively engaging the hook members 32 whereby the plurality of lamp members 28 are positionable along a length of the track member 22 as the hook members 32 are positioned along the track member 22 via the pole member 34.

The storage housing assembly 12 further includes a closure means 36 for selectively securing the lid portion 18 to the perimeter wall 16 closing the storage housing assembly 12. The closure means 36 further includes hook and loop fastener 38. A first portion 40 of the hook and loop fastener is coupled to a first surface 42 of the perimeter wall 16. A second portion 44 of hook and loop fastener 38 is applied to a second surface 46 of the lid portion 18. The first 40 and second 44 portions are complementary. The first 40 and second 44-portions are alignable when the lid portion 18 abuts the perimeter wall 16.

The closure means 36 further includes a hasp assembly 48. The hasp assembly 48 facilitating locking the storage housing assembly 12 in a closed position.

In use, a user would secure the track member beneath the eves of a roof. The track member would be secured in the desired location of the home's exterior and the lights would travel upon the track member. A quantity of hook members would be located throughout the track member or lights. A 12 foot pole member would be employed to move the light into the desired position. Prior to the holiday season the hook upon the end of the pole member would be employed to move the lights for display. After the holiday season, the lights could be moved and positioned within the storage housing assembly located at the end of the track member, beneath the eves of the home.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A positionable lighting system for use along a wall of a structure comprising:

a storage housing assembly couplable to a structure said storage housing assembly having a bottom wall and a perimeter wall extending upwardly from said bottom wall, said storage housing assembly having a lid portion pivotally coupled to said perimeter wall said storage housing assembly defining an interior space;

a track member couplable to the structure, said track member being elongate, said track member having a first end adjacent to said storage housing assembly;

a plurality of slideable support members operationally couplable to said track member, each one of said plurality of slideable support members being slideable alone said track member;

a plurality of lamp members operationally couplable to said plurality of slideable support members such that said plurality of lamp members being positionable along a length of said track member, said plurality of lamp members being positionable within said storage housing assembly; and a flexible elongate member coupled to said plurality of slideable support members, said flexible elongate member facilitating sliding said plurality of slideable support members along said track member such that a lateral force applied to a first one of said plurality of slideable support members is partially transferred to other slideable support members.

2. The system of claim 1, further comprising a plurality of hook members interspersed with said plurality of slideable support members, each one of said plurality of hook members being operationally coupled to said elongate member, said plurality of hook members being for facilitating said plurality of slideable support members along said track member.

3. The system of claim 1, further comprising a pole member for facilitating application of a lateral force along said elongate member such that said plurality of slideable support members are positionable along said track member whereby said plurality of lamp members are positionable along a length of said track member.

4. The system of claim 3, wherein said storage housing assembly being coupled to a vertical support surface such as an external wall of a house.

5. A positionable lighting system for use along a wall of a structure, comprising:

a storage housing assembly couplable to a structure said storage housing assembly having a bottom wall and a perimeter wall extending upwardly from said bottom wall, said storage housing assembly having a lid portion pivotally coupled to said perimeter wall said storage housing assembly defining an interior space;

a track member couplable to the structure, said track member being elongate, said track member having a first end adjacent to said storage housing assembly;

a plurality of slideable support members operationally couplable to said track member, each one of said plurality of slideable support members being slideable along said track member; and a plurality of lamp members operationally couplable to said plurality of slideable support members such that said plurality of lamp members being positionable along a length of said track member, said plurality of lamp members being positionable within said storage housing assembly;

wherein a flexible elongate member coupled to said plurality of slideable support members, said flexible elongate member facilitating sliding said plurality of slideable support members along said track member such that a lateral force applied to a first one of said plurality of slideable support members is partially transferred to other slideable support members;

wherein a plurality of hook members interspersed with said plurality of slideable support members, each one of said plurality of hook members being operationally coupled to said elongate member, said plurality of hook members being for facilitating said plurality of slideable support members along said track member;

wherein a pole member for facilitating application of a lateral force along said elongate member such that said plurality of slideable support members are positionable along said track member whereby said plurality of lamp members are positionable along a length of said track member; and wherein said storage housing assembly being coupled to a vertical support surface such as an external wall of a house.

6. The system of claim 5, wherein said pole member having a length of approximately 12 feet, said plurality of hook members further comprises three hook members, said pole member being for selectively engaging said hook members whereby said plurality of lamp members are positionable along a length of said track member as said hook members are positioned along said track member via said pole member.

7. The system of claim 5, wherein said storage housing assembly further comprises a closure means for selectively securing said lid portion to said perimeter wall closing said storage housing assembly.

8. The system of claim 7, wherein said closure means further comprises hook and loop fastener, a first portion of said hook and loop fastener being coupled to a first surface of said perimeter wall, a second portion of hook and loop fastener being applied to a second surface of said lid portion, said first and second portions being complementary, said first and second portions being alignable when said lid portion abuts said perimeter wall.

9. The system of claim 7, wherein said closure means further comprises a hasp assembly, said hasp assembly facilitating locking said storage housing assembly in a closed position.

* * * * *